US008544460B2

(12) United States Patent
Befus

(10) Patent No.: US 8,544,460 B2
(45) Date of Patent: Oct. 1, 2013

(54) APPARATUS AND METHOD FOR HEATING GROUND

(76) Inventor: Dale Befus, Calgary (CA)

( * ) Notice: Subject to any disclaimer, the term of this patent is extended or adjusted under 35 U.S.C. 154(b) by 0 days.

(21) Appl. No.: 13/298,600

(22) Filed: Nov. 17, 2011

(65) Prior Publication Data

US 2013/0062034 A1 Mar. 14, 2013

Related U.S. Application Data

(60) Provisional application No. 61/533,357, filed on Sep. 12, 2011.

(51) Int. Cl.
*F24J 3/08* (2006.01)

(52) U.S. Cl.
USPC ..... 126/271.1; 126/271.2 A; 126/271.2 R

(58) Field of Classification Search
USPC ..... 126/271.1, 271.2 A, 271.2 R; 165/45; 219/201
See application file for complete search history.

(56) References Cited

U.S. PATENT DOCUMENTS

| | | | | |
|---|---|---|---|---|
| 4,682,578 | A | 7/1987 | Schmidt | |
| 5,033,452 | A | 7/1991 | Carriere | |
| 5,174,751 | A * | 12/1992 | Chapman et al. | 432/227 |
| 2003/0124315 | A1 | 7/2003 | Grochoski | |
| 2005/0103776 | A1 | 5/2005 | Nielson et al. | |
| 2010/0119306 | A1 | 5/2010 | Albert | |

* cited by examiner

*Primary Examiner* — Alfred Basichas
(74) *Attorney, Agent, or Firm* — Scott T. Griggs; Griggs Bergen LLP

(57) ABSTRACT

An apparatus and method is provided for preparing frozen ground for construction-type work includes using arrays of heat sources placed over the surface to be heated. The apparatus can warm the surface in preparation for the construction activity with energy penetrating into the ground affording efficient thawing of materials below 20 centimeters of depth. Heat sources used in the array can include emitted infrared radiation.

19 Claims, 11 Drawing Sheets

APPARATUS AND METHOD FOR HEATING GROUND

PRIORITY STATEMENT & CROSS-REFERENCE TO RELATED APPLICATIONS

This application claims priority from U.S. Patent Application No. 61/533,357, entitled "Apparatus and Method for Heating Ground" and filed on Sep. 12, 2011, in the name of Dale Befus; which is hereby incorporated by reference for all purposes.

TECHNICAL FIELD OF THE INVENTION

The present disclosure is related to the field of ground heating equipment, in particular, radiant heaters used for heating ground and for thawing frozen ground.

BACKGROUND OF THE INVENTION

Much construction in modern economies lie in building, installing, and maintaining surface and subsurface structures such as roads, water distribution, drainage systems, pipelines, barriers, fences, electrical transmission infrastructure, telecommunication infrastructure, and the like. In cold climates, frost persists in the ground for much of the year rendering summertime equipment for penetrating the surface (e.g., digging, trenching, ploughing, filling, sealing, and the like) ineffective without first thawing the ground. This circumstance is particularly pronounced in the urban environment where frost is typically much deeper and precise dimensionality of subsurface penetration much more critical. Many construction techniques are available for thawing the top 10 centimetres of ground fairly efficiently. However few services are buried at such depths and many services are situated deep within the frost zone. Consequently, controlling the dimension of the thaw has become increasingly important as too little thawing at the required dimension and depth leads to difficulty moving the earth as desired while too much thawing may cause problems such as wasted energy or sloughing of the adjacent terrain.

Concurrently with the proliferation of subsurface structures that has occurred in the past 60 years, there has been an evolution of regulations and standards in the construction industry arising from improved understanding in the engineering, occupational safety, environmental, urban-planning, fire-safety, and allied fields. Meeting these regulations is often challenging and expensive. In order to achieve operating profitably within these evolving limitations contractors have had to investigate new ways to achieve their ends Heat transfer for thawing is typically accomplished by a combination of conduction, convection, and radiation. Conventionally, ground heating or thawing is typically undertaken by 1) piping heated fluids (e.g., glycerol) through hoses having a serpentine configuration disposed under thermal blankets or soil, 2) heating enclosed air over a construction site, 3) placing a portable heating enclosure over the target ground or 4) burning materials (usually a coal-straw mixture) over the ground to be thawed.

Serpentining piping filled with heated fluids under thermal blankets (e.g. Grochoski, U.S. Application No. 2003/0124315) or within mats (e.g., Albert, U.S. Application No. 2010/0119306) are designed mainly for surface heating and curing of concrete. For trenching, pipes or tubes are sometimes buried to gain the transmission and insulating effects. For curing of concrete, the blankets absorb significant amount of the heat output providing a relatively uniform lateral heat distribution for the air under the blankets. When used for deep thawing, the downward radiation and conduction is a relatively small part of the energy output; thus, the technique can be slow and may result in uneven thawing at target depths. Moreover, this technique can lead to significant loss of energy over the length of the hoses or pipes, especially when the heat source is far from the thaw zone. Also, while thaw zones are characteristically targeted as right angular plans, hoses are typically of different size than the target zone and must be laid out in hairpins to approximate the layouts of these planned construction zones. Uneven distances between these conduits may also result in uneven heating throughout the target thaw zone. At any given construction site, one or more of these limitations may result in difficulty in planning or meeting schedules.

Similarly, when one heats an indoor air environment inside of shrouding or a canopy, the working environment may comfortable and enclosed surfaces compliant to best practices for curing, sealing and the like but ground thawing is superficial and normally not dimensionally compliant to the enclosure at depth. The shape of the subsurface thaw will also be deepest in the middle while achieving very little thawing at the edges of the thaw zone. Investigators have tried to use general-purpose construction heaters for blowing radiant heat to warm the air (e.g., Schmidt, U.S. Pat. No. 4,682,578) or canopies with suspended heating devices (e.g., Nielson et al., U.S. Application No. 2005/0103776) achieved some thawing but had difficulty with deep thawing. These methods are sometimes even impotent for frost deeper than 20 cm. This result may be magnified in harsh conditions as the susceptible to the elements of weather wherein colder or faster moving air absorbs the energy the contractor wants focused on the target ground. Again, any of these complications may result in a contractor having difficulty planning or meeting schedules.

As an alternative, certain devices are sold that provide a propane burner with a case or outer housing. U.S. Pat. No. 5,033,452 (issued to Carriere) theorizes that liquid water on the ground surface is a major impediment to ground thawing and that removal is an improvement in efficiency. Carriere discloses a thawing device having a thermally insulated housing and a single undivided fire tube mounted within the housing. The fire tube has a first end connected to one port in the housing and a second end connected to another port in the housing. A burner is mounted outside the housing in the first end of the fire tube, that tube running along the ground surface, and a flue for exhausting the combustion gases is connected adjacent the second end. Heat transmitted from the fire tube directly into the ground and interior of the housing serving to evaporate water. The housing includes a steam vent to provide egress for the moisture. Carriere does not concern himself with the evenness of the thaw within the device or how his devices may be used in collaboration to achieve an intended result.

Another ground thawing-device, called "Frost Hog," is manufactured by Leric Holdings, Ltd., of Lloydminster, Alberta, Canada. The device includes a heavy trailer-mounted housing and a fire tube extending through the housing from one port to another port. A burner is positioned in the first port and a vertical flue for exhausting the combustion gases is positioned adjacent the second port. Because of its size and trailer mount, the unit is difficult to place between structures (for example between a garage and a fence) and cannot be used in contiguous arrays that would thaw ground for contiguous underground structures such as gas or electrical service.

Yet another ground-thawing device, called the "Thaw Dawg", is manufactured by Ground specialties Incorporated of Minneapolis, Minn., U.S.A. The device comes with a 36"× 48" case with an open bottom and provides a burner attached to one of the 48" sides of the case. The external burner limits its use near building structures and trees and results in the production of waste heat. Even though the burner is relatively close to all parts of the enclosure, in our hands, the heat and thawing is most intense directly below the burner and thawing underground occurs in an inverted, non-circular, conical fashion. Accordingly, this device does not predictably allow trenching of the entire dimension of the case footprint in a period less than 48 top 72 hours. Moreover, if placed end to end to enable the digging of a 48" wide trench, for example, the external burner box and inverted conical thawing at depth would result in intermittent segments where there is difficult digging in frozen ground.

Consequently, for many years trenching contractors almost universally burned mixtures of coal and straw laid out along a trench-line to thaw terrain for digging on subsequent days. This technique was not without drawbacks. When temperature dropped rapidly overnight, the inability to capture heat and direct the heat downward often resulted in incomplete thawing within the production schedule. This technique also suffered from intermittent loss of ignition by vandalism, rain, snow, melt water or discontinuities in fuel as well as pollution through emission of smoke, cinders, and odor. Accordingly, contractors needed to employ personnel for monitoring the burn over extended periods of time. Even with monitoring, the combination wind and cinders, left an ever-present fire hazard. Accordingly, this technique was particularly unsafe for use near construction equipment, buildings, as well as in dry fields, or wooded areas. If there were delays between burning and trenching, the local microenvironment was uncontrolled resulting in the potential for refreezing. For these fire and environmental reasons, using unattended burning materials for ground preparation is a practice now banned in many jurisdictions. Nonetheless, this method forms the "gold standard" for efficacy against which all other methods are measured.

Accordingly, all conventional deep-thawing practices suffer the common problem of scheduling reliably. Under well-controlled conditions, the method of burning a straw-coal mixture along a trench-line typically achieved a centre-line deep thaw of approximately 3 feet or 1 meter in 72 hours where there has been a successful burn. Depending on the outside air temperature, the use of construction heaters in a tarped-in or canopied area may achieve one half of that depth in a similar period along the centre-line of the structure. Using hydronic heaters with insulating blankets would typically achieve a thawing result somewhere between these two methods. Efficacy of various portable inventions is highly variable depending upon the task assigned. None of the above-mentioned methods reliably leave a dimensionally uniform thaw zone at a predictable time. Accordingly, the more spatially complex the target thaw zone becomes, the more refractive scheduling becomes for any given subsurface construction activity.

It is, therefore, desirable to provide an apparatus and method for thawing frozen ground that overcomes the shortcomings of the prior art.

SUMMARY OF THE INVENTION

In some embodiments, a deep-ground-thawing method is provided that can 1) repeatably and 3-dimensionally heat or thaw the ground commensurate with the length, width, and depth of the task; 2) accomplish the task predictably within the 4th dimension, i.e., within a known time period; 3) be energy efficient, 4) be safe with respect to humans, animals and surrounding structures in conformance with modern fire, environmental, and occupational health regulations; and 5) use means that are adaptable to complex construction environments. For the purposes of this specification and the claims herein, the term "ground" means natural earth, sod, loam, peat moss, marl, muskeg, rock, sand, gravel, silt, clay and the like as known to those skilled in the art in addition to man-made compositions such as asphalt, concrete and other engineered or geotechnical soil construction compositions and materials used in civil engineering projects as known to those skilled in the art.

In some embodiments, the apparatus and method presented herein can provide means for efficiently providing heating and deep thawing in a modern construction environment. In some embodiments, dimensionally fixed, unitized heaters are provided that can collaborate in arrays to evenly thaw a surface in a desired dimension in a timely manner. Accordingly, these unitized heaters can be used like "building blocks" and positioned to achieve the individual and collaborative thaw patterns desired. In some embodiments, individual arrays of the heaters can collaborate to achieve very complex thaw patterns.

In some embodiments, infrared radiant heaters can be used alone or in conjunction with other components and techniques for achieving more uniform heating or thawing. Such components and techniques can include increasing the surface area of radiating conduit by such strategies as double tubing. In some embodiments, the heaters can be enclosed with highly reflective material in order to scatter the reflected radiant energy over the entire target ground surface. In some embodiments, fans or blowers can be provided to help ensure that the heat is more efficiently and evenly radiated within the heater enclosure.

In some embodiments, the apparatus and method presented herein can achieve a similar or better heating or thaw depth with superior dimensionality to other conventional methods within comparable heating or thawing times over a broad range of climatic conditions. To achieve these goals, the apparatus, in some embodiments, can be configured to collaborate in arrays. In contrast to the conventional ground-heating methods wherein heat energy is produced in one location and transported to the zone of interest by gas or fluid, the apparatus presented herein can be configured such that each part of the overall spatial dimension of ground to be heated can be supplied with a heat source of predictable heat or thaw dimension. In some embodiments, each heater can provide more uniform deep heating or thawing within its footprint on the surface on the ground without loss to distal heating or thawing. When placed adjacent to other heating devices of defined dimension, the unitized fixed-form heating devices can overlay the heat or thaw areas as defined in construction plans similar to the concept to of setting out building blocks. By this method, the heaters can collaborate to provide maximal heat for deep heating or thawing within the dimension of the array of devices and heating or thawing of unnecessary ground is minimized. No energy is lost from transporting heat from an external energy source (e.g. a furnace or boiler) to the heat or thaw zone as used in other conventional prior art heating apparatuses and methods.

In some embodiments, the apparatuses and methods described herein can be used to heat or thaw buried flow-lines that carry produced substances from a well, such as water, oil, gas and the like. In cold weather conditions, any water in the produced substances can freeze and block the flow-line. In addition, a flow-line can become "waxed off"; meaning that wax can build up in a flow-line carrying oil and block the flow-line. The apparatuses described in this specification can be placed on the ground over the flow-line and heat the ground to either thaw the water frozen in the flow-line or to melt the wax built up in the flow-line so as to clear the blockage in the flow-line and allow produced substances to flow once again.

In some embodiments, the apparatuses and methods described herein can be used to pre-heat the ground for a construction activity. One example can include pre-heating asphalt around a pothole on a road to enable new asphalt used to fill the pothole to bond to the surrounding asphalt and thus produce a better repair of the pothole. Other examples can include heating the ground prior to adding new or additional ground material where heating the ground improves the adhesion of the new or additional ground material to the existing ground material.

Broadly stated, in some embodiments, a ground-heating apparatus is provided, comprising: a frame configured to sit or be placed on the ground; a heat exchanger disposed in the frame, the heat exchanger configured to emit heat energy; and a heater assembly, the heater assembly operatively coupled to the heat exchanger, the heater assembly configured to convey heated air or gas through the heat exchanger.

Broadly stated, in some embodiments, a system is provided for heating ground, comprising at least one heating apparatus, each at least one heating apparatus comprising: a frame configured to sit or be placed on the ground; a heat exchanger disposed in the frame, the heat exchanger configured to emit heat energy; and a heater assembly, the heater assembly operatively coupled to the heat exchanger, the heater assembly configured to convey heated air or gas through the heat exchanger.

Broadly stated, in some embodiments, a method is provided for heating ground, the method comprising the steps of: providing at least one heating apparatus, each at least one heating apparatus comprising: a frame configured to sit or be placed on the ground, a heat exchanger disposed in the frame, the heat exchanger configured to emit heat energy, and a heater assembly, the heater assembly operatively coupled to the heat exchanger, the heater assembly configured to convey heated air or gas through the heat exchanger; placing the at least one heating apparatus on an area of frozen ground; and operating the at least one heating apparatus to emit heat energy wherein at least a portion of the ground is heated.

DETAILED DESCRIPTION OF THE INVENTION

Figure 1:
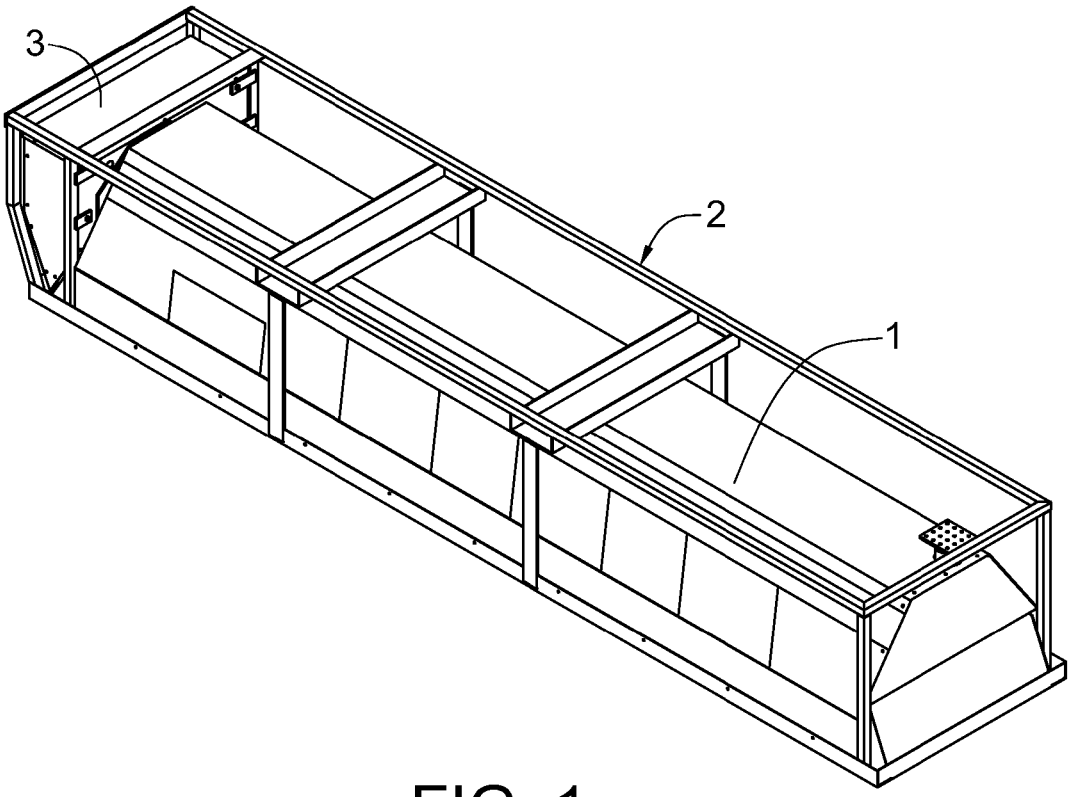
FIG. 1 is a perspective view depicting one embodiment of an apparatus for thawing ground where reflector assembly 1, frame 2, and burning enclosure 3 are visible.

An apparatus and method for thawing frozen ground is provided herein. In some embodiments, the apparatus and method can comprise one or more unitized thawing devices, means for transporting the devices, and means for controlling the devices as well as the components for the system.

For the purposes of this application, the following terms are defined as follows.

"Array"—means devices arranged for heating thawing the ground in dimensional conformance with all or part of an existing or planned surface or subsurface structure. These devices may share one or more energy sources to achieve a desired collaborative effect. Where the surface target is not rectangular, placing a group of rectangular arrays or sub arrays adjacent to each other can form a thawing system. In the alternative, combinations of devices including non-rectangular shaped devices can be employed.

"Device" means a unitized fixed-form ground-heating device configured for heating or thawing the ground in dimensional conformance with all or part of an existing or planned ground surface or subsurface structure. When used herein to refer to a member of an array, the words "unit" and "device" are used interchangeably.

"Heat-transfer plane" means a plane covered by one or more unitized fixed-form ground-heating device that can provide a plane through which heat energy can be dimensionally transferred to the target ground surface. With devices comprising infrared heaters, this plane can allow energy to directly travel to the ground without any obstruction.

"Low emission device" means a low emission device that meets applicable standards for indoor or outdoor air quality depending upon the circumstances. In general, a low emission device for indoor use would also be a low emission device for outdoor use.

"Thawing system" means a system that can comprise the asset management, transport, fuel supply, and control of devices whether employed as one or as a plurality of devices configured in arrays collaborating to achieve a thawing task.

In some embodiments, a device can comprise an infrared radiation heat source. In some embodiments, the source of infrared heat can comprise an infrared tube heater. In these embodiments, a burner control box can ignite a gas-air mixture and fan the hot gases into a radiant tube assembly. As the gases pass through the tube assembly, the tube assembly is heated and can emit infrared radiation at intensity levels proportional to the temperature of the tube. In some embodiments, the device can emit heat towards the ground directly or indirectly by a reflector configured to reflect emitted heat towards the ground. The ground within the targeted surface can absorb this radiation and can further re-radiate it as secondary infrared radiation.

In some embodiments, a plurality of devices can be configured into an array for thawing an area of frozen ground larger than the footprint of a single device. In some embodiments, the devices can be unitized such that each device can be self-contained and can provide the heat necessary for dimensionally heating the ground directly below it. In other embodiments, the devices can be shaped in a fixed form to conform to standard sizes of thaw zones, as they would be encountered on a construction site. When used in collaboration in an array, the unitized fixed-form devices can afford the ability for all devices of a given array to complete their task at or about the same time, regardless of the complexity of the dimensions of the thaw zone.

In some embodiments, the devices can be aligned over the dimensions of a planned construction activity, connected to a fuel source, and turned on. In some embodiments, the heat output from each device can be set so that the surface can be readied according to a construction timetable. In some embodiments, the heat output from each device in an array can be set so that the ground surface under the array can be readied at the same time. In some embodiments, the heat output from each device in an array can be set so that portions of the surface under the array can be readied sequentially according to a construction timetable.

Figure 7A:
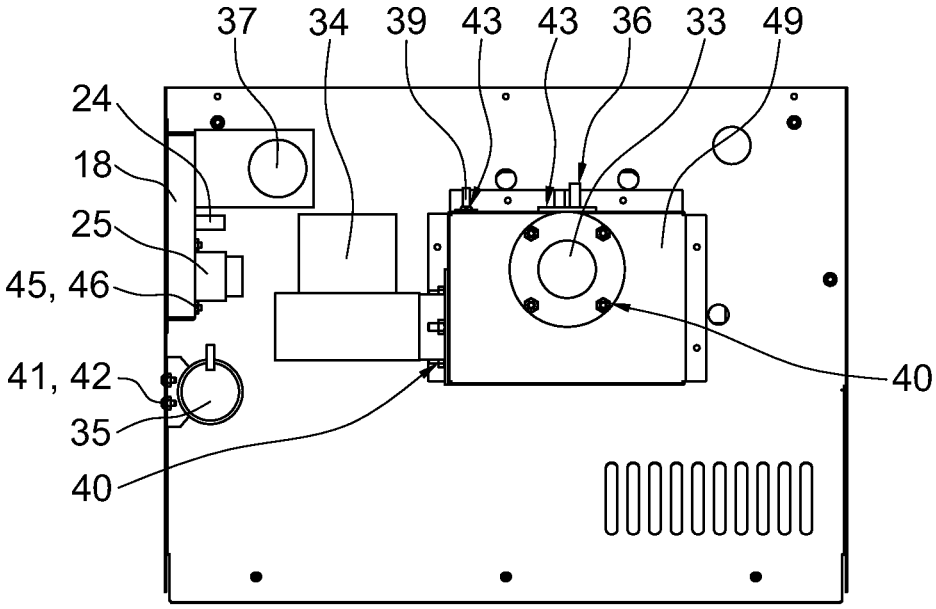
FIG. 7A is a front elevation view depicting the burner assembly of FIG. 6 with its enclosure removed.
Figure 7B:
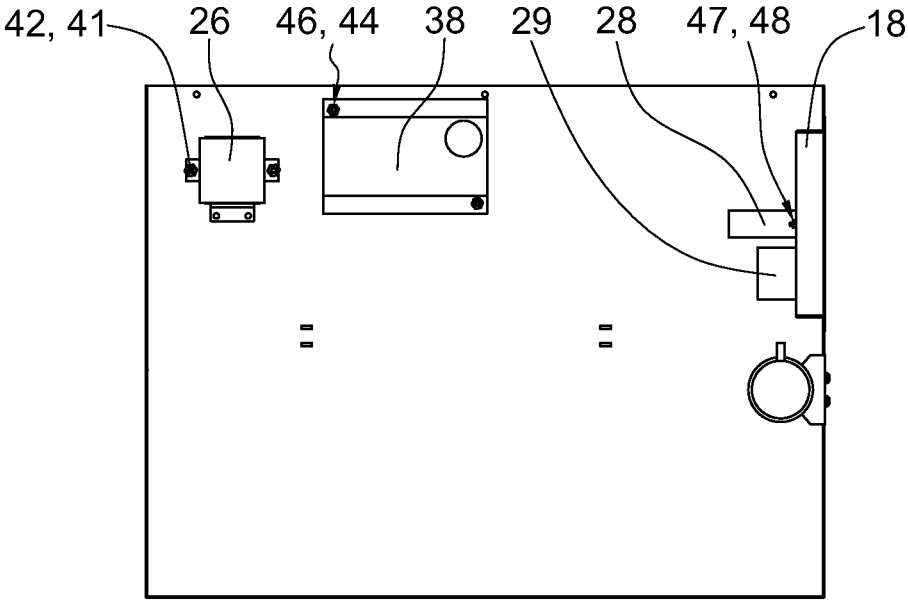
FIG. 7B is a rear elevation view depicting the burner assembly of FIG. 6 with its enclosure removed.
Figure 8:
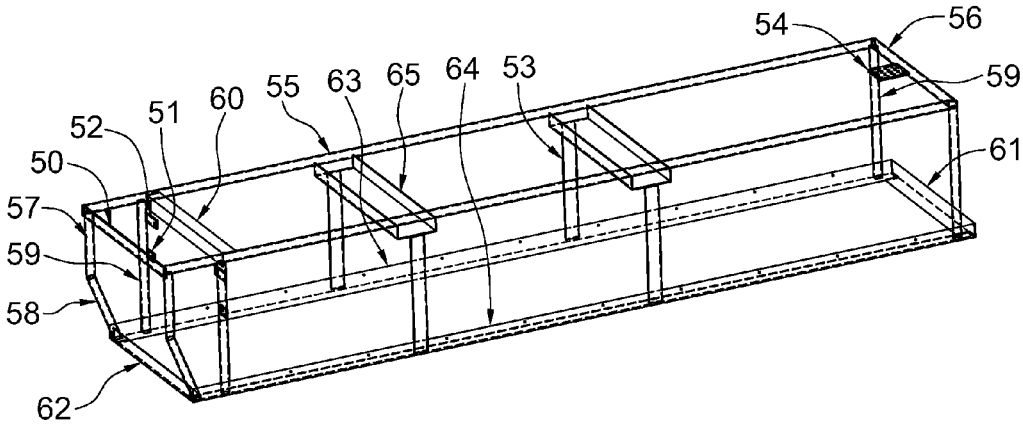
FIG. 8 is a perspective view depicting the rigid exoskeleton frame of the apparatus of FIG. 1.

In some embodiments, each device can be equipped to uniformly distribute heat to the dimension of its footprint. In other embodiments, uniform distribution of heating can be accomplished by combining infrared radiant heating and reflectors that can focus this energy evenly within the footprint of the device. In some embodiments, each device can be equipped with a means of forcing heated air through at least one radiating conduit. In other embodiments, uniform distribution of heating can be accomplished by combining infrared radiation heating, reflectors, and forced air to focus this energy evenly within the footprint. In some embodiments, forced air can be impelled from burner assembly 49 by fan or blower 34, as shown in FIG. 7A. In some embodiments, a plurality of radiating conduits can be employed to distribute heat energy evenly within the footprint. In one aspect, conduits can be connected in parallel. In some embodiments, a plurality of radiating conduits can be connected sequentially to distribute energy evenly within the footprint. In a representative embodiment, a plurality of radiating conduits can be sequentially connected by double tubing 66, 67, as shown in FIG. 9, to distribute energy evenly within the footprint.

In some embodiments, the method can comprise warming and/or clearing ice from a surface to provide passage of surface traffic. In some embodiments, the method can comprise heating and/or drying a target ground surface to the degree needed for a repair of the surface. In some embodiments, the method can comprise heating the target ground to a degree needed to eliminate contaminants disposed in the ground. In some embodiments, the method can comprise heating the target ground to a degree needed to thaw frost up to six feet down. In some embodiments, the method can comprise heating the target ground is heated to a degree needed to thaw frost up to 3 cm/hour.

In some embodiments, arrays of devices can be used spatially or temporally in collaboration with conventional methods to heat a target frozen ground zone. In some embodiments, insulating blankets canopies, tarps or other protection from the wind and cold can be employed with the devices. In some embodiments, conventional construction heaters can be employed in combination with the devices to heat the protected environment. In some embodiments, hydronic heaters can be used in combination with arrays of devices to accomplish specific portions of a thawing task. In some embodiments, conventional heaters can be used concurrently with arrays of devices. In some embodiments, conventional heaters can be used sequentially with arrays of devices. In some embodiments, conventional heaters can be used prior to the use of arrays of devices in preparation for deep thawing. In some embodiments, conventional heaters can be used after the use of arrays of devices to maintain deep thawing of frozen ground.

Referring to FIG. 1, one embodiment of a heating device is shown. In some embodiments, the shape of unitized heater 1 can be formed by supporting frame 2 that, in turn, can support a heating unit comprising an infrared heating unit further comprising burning enclosure 3. Such heaters 1 can be set out adjacent to each other in almost any combination to collaborate in the thawing of a zone with almost any desired shape. In some embodiments, heater 1 can comprise a radiant heating conduit disposed under a reflective surface.

Figure 2A:
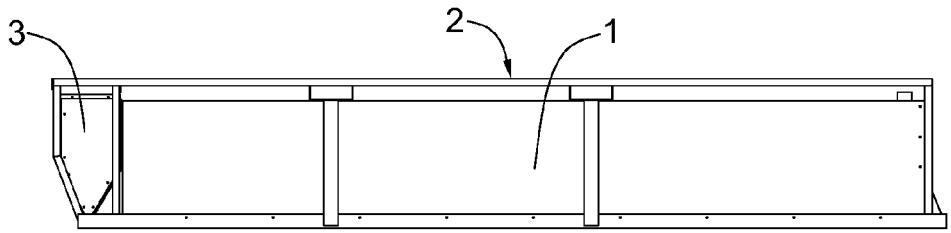
FIG. 2A is a side elevation view depicting the apparatus of FIG. 1 wherein reflector assembly 1, frame 2, burning enclosure 3, and piping assembly 4 are visible.
Figure 2B:
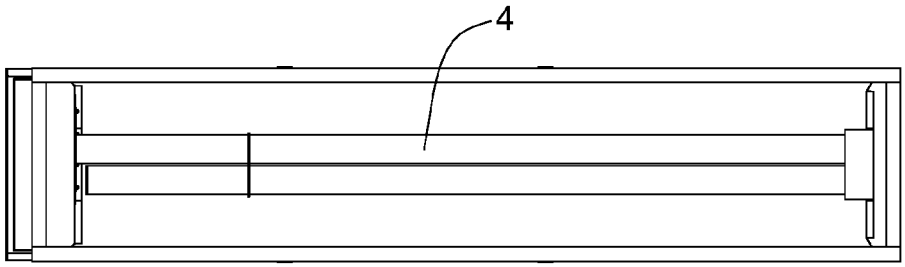
FIG. 2B is a top plan view depicting the apparatus of FIG. 1 wherein reflector assembly 1, frame 2, burning enclosure 3, and piping assembly 4 are visible.

Referring to FIGS. 2A and 2B, piping assembly 4 can be suspended within burning enclosure 3. In some embodiments, piping assembly 4 can be centered in a reflector to maximize the amount of primary and reflected energy reaching the ground. In other embodiments, the reflector can comprise at least one surface made from a reflective material. In some embodiments, the reflector can be shaped to direct energy in a downward direction. In some embodiments, the reflecting surface can be integral to the reflector structure. In other embodiments, the reflective material can further comprise physical or mechanical means such as coating, deposition, or a securing means such as rivets or screws. In some embodiments, the reflective material can comprise a corrosion-resistant material. In another preferred embodiment the reflective material is coated with corrosion-resistant protection means. In some embodiments, the reflective material can acts as an infrared mirror. In some embodiments, the reflective material can comprise one or more corrosion-resistant materials from the group consisting of stainless steel, silver, aluminium and gold. In some embodiments, the reflector can be coated with an insulating paint. In some embodiments, the insulating paint can comprise ceramic micro-spheres.

Figure 3:
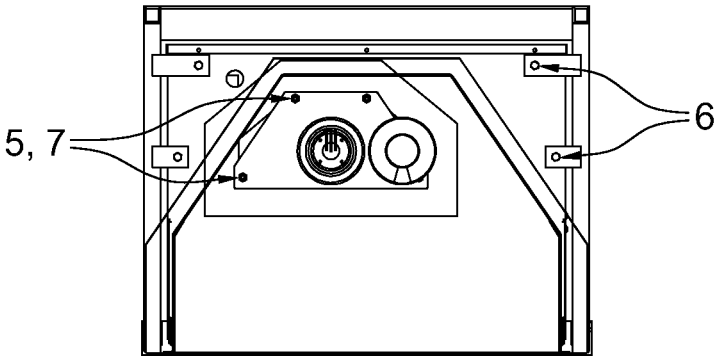
FIG. 3 is a an end elevation view depicting the apparatus of FIG. 1 wherein the piping assembly is secured by 4 hex bolts as represented by 5, 6, and 7.
Figure 4:
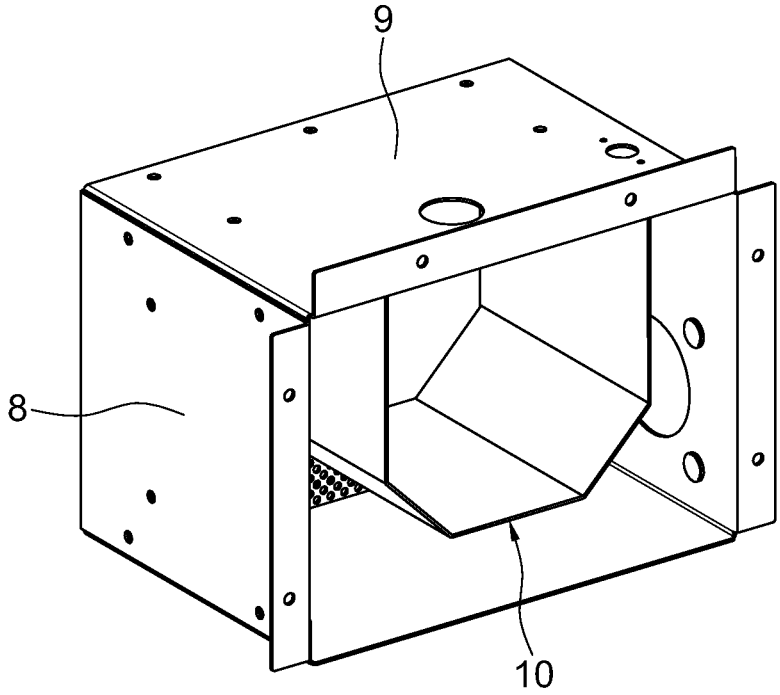
FIG. 4 is a perspective view depicting the burning enclosure of the apparatus of FIG. 1.

In some embodiments, piping assembly 4 can be secured at one end of burning enclosure 3 by a securing means. As shown in FIG. 3, in some embodiments, piping assembly 4 can be secured by one or more hex bolts to provide easy removal when replacement or maintenance is called for. In this embodiment, the piping assembly 4 is secured at the other end by attachment to burning enclosure 3 by a securing means. In some embodiments, burner wall 8, burner wall 9, burner bracket 10, and air diffuser 11 can enclose the burner as shown in FIG. 4. This burner enclosure may take many forms but its primary function is to provide for the safe ignition of the fuel used. In some embodiments, piping assembly 4 can comprise a U-shape, as shown in FIG. 2.

In some embodiments, piping assembly 4 can comprise a radiant conduit formed from steel. In some embodiments, the steel can comprise alloy elements that do not exceed the following limits: 1% carbon, 0.6% copper, 1.65% manganese, 0.4% phosphorus, 0.6% silicon, and 0.05% sulphur. In some embodiments, the conduit can be formed from AISI 1022 grade steel. In some embodiments, the conduit can be constructed from 4" tubes formed from AISI 1022 steel. In some embodiments, the radiant conduit can be formed from 4"×106.69" tube made from AISI 1022 steel, as shown as 66 and 67 in FIG. 9. In some embodiments, an exhaust system can be provided from materials of similar metallurgic properties. In some embodiments, the exhaust system can comprise tubes 70, 72 and an elbow 73. In some embodiments, tubes 70 and 72 can be comprised of 2" steel tube.

In some embodiments, each device can comprise a low emission device.

In some embodiments, the device can comprise an instrument panel. Referring to FIGS. 6A-E and 7A-B, panel 18 can comprise enclosure wall 19, enclosure wall 20, burner box centralizer 21, enclosure lid 22, nozzle shield 23, light 24, flanged inlet receptacle 25, transformer 26, hole 27, hour meter 28, ON/OFF switch 29, plug button 30, and borosilicate glass 31. In yet another preferred embodiment the components of each device are organized in a modular fashion for ease of repair, inspection, and possibly replacement. In some embodiments, the device can comprise an infrared tube heater. In some embodiments, the burner box assembly, the piping assembly, and the control assembly can be configured that they can easily be removed as single units.

Figure 9A:
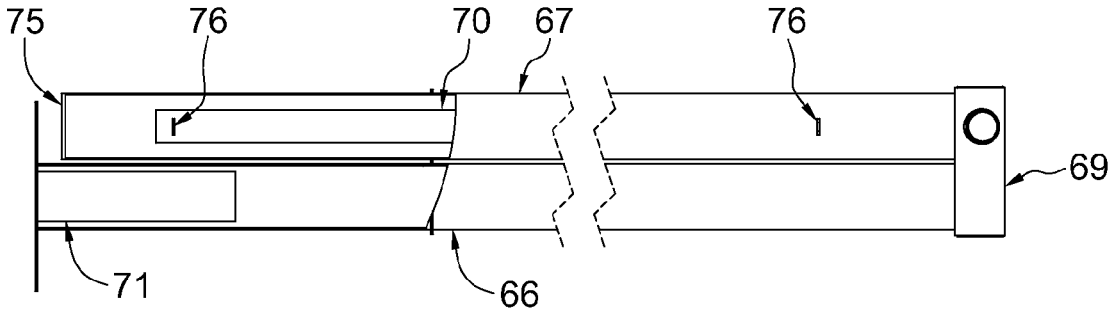
FIG. 9A is a top plan view depicting the piping assembly of the apparatus of FIG. 1.
Figure 9B:
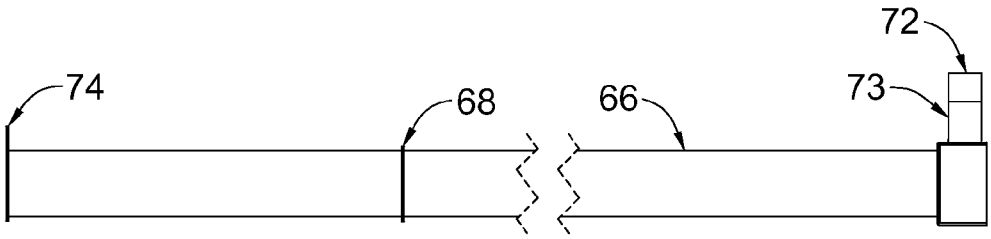
FIG. 9B is a side elevation view depicting the piping assembly of the apparatus of FIG. 1.
Figure 10:
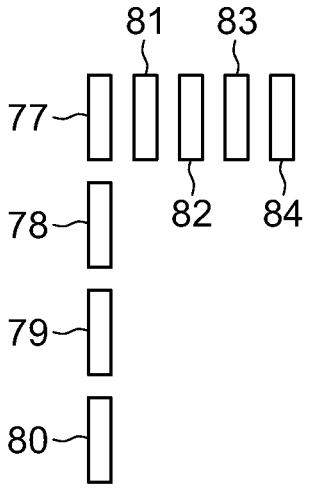
FIG. 10 is a block diagram depicting an array of rectangular embodiments of the apparatuses of FIG. 1 for thawing frozen ground.
Figure 11:
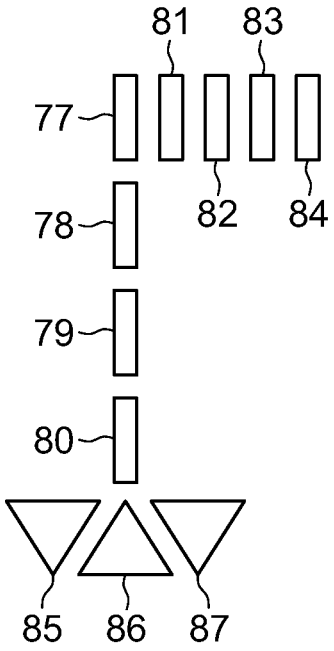
FIG. 11 is a block diagram depicting an array of rectangular and triangular embodiments of the apparatuses of FIG. 1 for thawing frozen ground.

In some embodiments, the exhaust system can release exhaust gas in a manner that affords safe collaboration of devices. In some embodiments, the exhaust gas can be ported to the environment directly or through a hose or a pipe assembly. In some embodiments, the exhaust gas can pass through a diffuser or other protective devices to prevent workers from being inadvertently burned by hot gases. In some embodiments, the exhaust can be ported such as to not create an operating hazard for neighbouring devices of the array or nearby structures. In some embodiments, the diffuser can be attached to the frame to allow heat from the gas to be absorbed and conducted by the frame. In some embodiments, all or part of the exhaust gas can be ported through the frame to capture and passively diffuse residual heat. In some embodiments, exhaust gas can be released vertically as shown in FIGS. 9A and 9B.

Figure 5A:
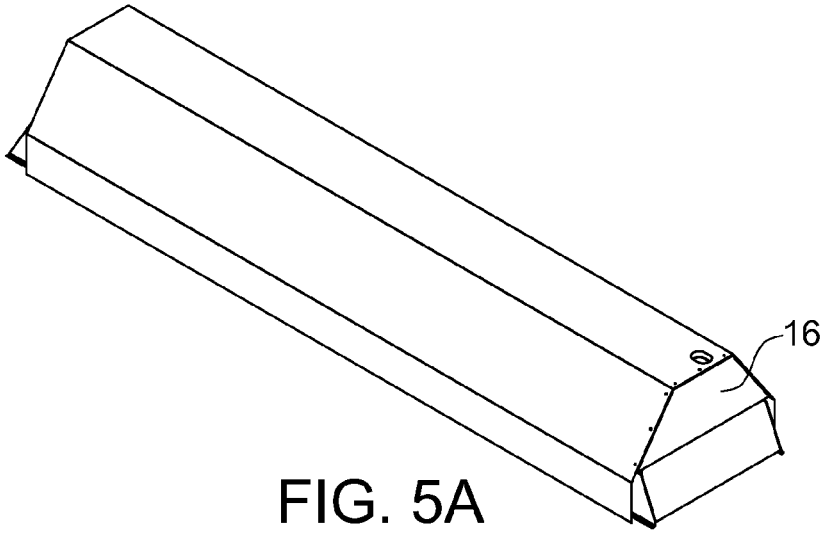
FIG. 5A is a perspective view depicting the reflector unit of the apparatus of FIG. 1.
Figure 5B:
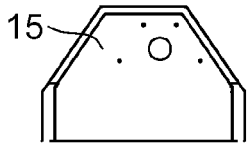
FIG. 5B is an end elevation view depicting the reflector unit of the apparatus of FIG. 1.
Figure 5C:
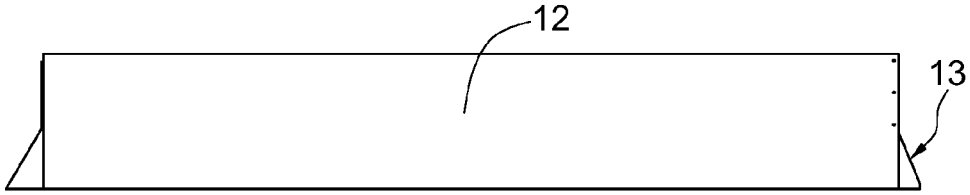
FIG. 5C is a side elevation view depicting the reflector unit of the apparatus of FIG. 1.
Figure 5D:
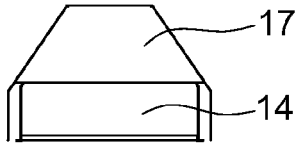
FIG. 5D is an end elevation view depicting the reflector unit of the apparatus of FIG. 1.
Figure 6A:
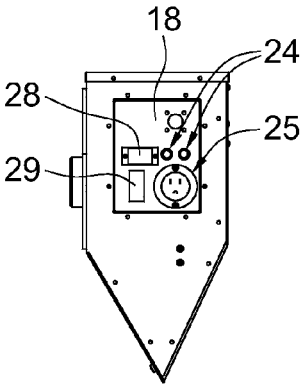
FIG. 6A is a left elevation view depicting the burner assembly of the apparatus of FIG. 1.
Figure 6B:
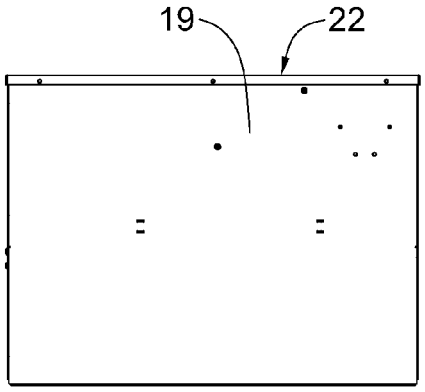
FIG. 6B is a rear elevation view depicting the burner assembly of the apparatus of FIG. 1.
Figure 6C:
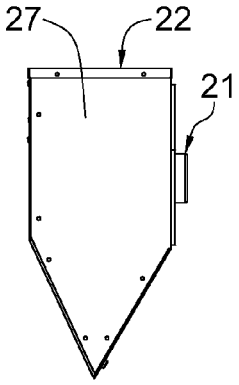
FIG. 6C is a right elevation view depicting the burner assembly of the apparatus of FIG. 1.
Figure 6D:
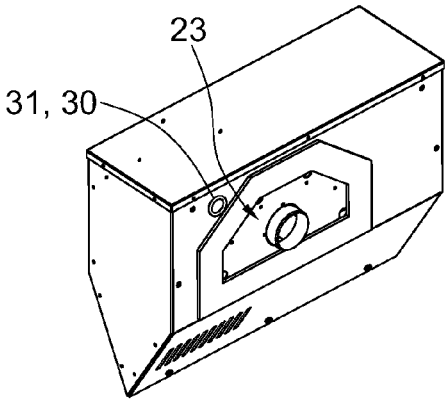
FIG. 6D is a front perspective view depicting the burner assembly of the apparatus of FIG. 1.
Figure 6E:
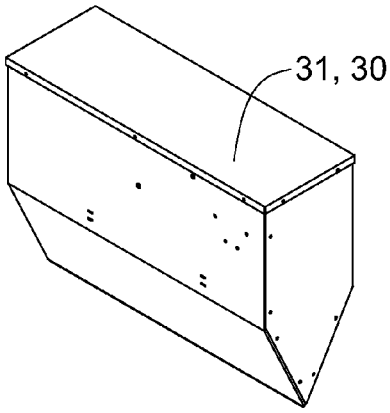
FIG. 6E is a rear perspective view depicting the burner assembly of the apparatus of FIG. 1.

In some embodiments, a means to focus energy on the target ground assigned to the unit can be provided. In infrared tube heater devices, a reflective surface can be provided above and to the sides of the radiant heating conduit. In some embodiments, the reflector can extend over, to the sides, and for the entire length of the heating conduit. In some embodiments, the reflector can be shaped like reflector 13 as shown in FIG. 5C. As illustrated in FIGS. 5A, 5B, 5C and 5D, reflector 13 can be surrounded by outer case 12, and attached to reflector end walls 14, 15 as well as pipe support bracket 16, and reflector end cover 17.

In some embodiments, the heat can be produced by converting energy from sources including electricity and hydrocarbon fuels. In some embodiments, the hydrocarbon fuel can be selected from one or more from the group consisting of natural gas, one of its components, e.g. methane, propane, etc., gasoline, kerosene, diesel fuel, heating oil, and other suitable hydrocarbons as well known to those skilled in the art. If an infrared tube heater is used, propane can be used as the fuel in some embodiments. In some embodiments, the heat each device in an array can produce can be controlled by the regulation of the fuel supply to each device.

The size and shape of the device used in an array are important for the array to conform to the size and shape of the target zone for heating. In some embodiments, an array can be comprised of devices sized and shaped to conform to all or part of the intended surface or subsurface structure. Examples of target zones for heating include graves, walls, trenches, pipelines, electrical utilities, telecommunication utilities, water utilities, footings, and basements. In some embodiments, the device can be rectangular in shape. In some embodiments, the device can be round or ovoid in shape. In some embodiments, the device can be shaped for thawing ground for planned footings or post holes. In some embodiments, the device can be round and sized to thaw a bell hole. In some embodiments, the device can be shaped to match the width of a planned trench. In some embodiments, the device facing the ground can be quadrangular or polygonal in shape. In some embodiments, the device can be circular or elliptical in shape. In some embodiments, the device can comprise a shape that is a combination of one or more polygonal, circular and elliptical shapes. In some embodiments, an array of identically shaped devices can be utilized. In some embodiments, the device can be rectangular and shaped to match the width of a trench and can be 2 to 10 times longer than it is wide. In some embodiments for thawing the ground for trenches less than 30 inches wide, the surface dimension of the device can be approximately 24 inches×120 inches. In some embodiments for thawing the ground for trenches less than 30 inches wide, the dimension of the device (including the frame) can be approximately 26"(w)×23"(h)×120"(l). For wider trenches, larger devices or side-by-side array configurations can be employed. In some embodiments, the device can be used in a planned construction activity, such as installing artificial turf, landscapes, roads, sidewalks, curbs, parking lots, gutters, rail lines, utility junctions, runways, concrete slabs, or patios. In some embodiments, the planned construction activity can comprise the repairing of a ground or surface defect. In some embodiments, the planned activity can comprise the curing or drying of a material.

In some embodiments, an array can comprise a device shaped such that the plane facing the ground surface has a shape selected from the group consisting of: triangular, quadrangular, pentangular, sextantular, septangular, octangular and polygonal. In some embodiments, the array can comprise one or more devices whose surface footprint is rectangular.

In some embodiments, the device can comprise a rigid frame configured to conform to the shape of the target ground to be heated. In some embodiments, a rigid frame is provided to support and protect the heating unit of the devices during operation. In some embodiments, the rigid frame can be configured to be stacked on one another for storage in the off-season. In some embodiments, the frame can be configured for manual or machine positioning within an array. In some inventions, the rigid frame can provide means for securing multiple devices during transportation. In some embodiments, the rigid frame can be configured for interlocking a device with adjacent devices. In some embodiments, the rigid frame can be configured for of securing additional insulation or protection thereto for protection from the elements. In some embodiments, the device can comprise one or more thermal blankets to cover all or part of the frame. In some embodiments, the array can be laid out within a canopied or tarped-in enclosure.

In some embodiments, the frame or case of a device can be used to focus environmentally available energy on the function of the device. In some embodiments, the device (frame or case) can be painted or shrouded in black to incorporate or absorb passive solar heat or energy to assist in the heating function. In some embodiments, the device (frame or case) can be configured with solar cells or windmill means to generate electricity for device function through solar or wind power. In some embodiments, material can be applied or attached to the target thaw zone to enhance the absorption and re-radiation of heat energy.

In some embodiments, devices in an array can be oriented by spatially adjacency without a mechanism of interlocking. In some embodiments, the devices can be interlocked to one another. In further embodiments, devices can be interlocked to prevent theft. In some embodiments, an array of devices can be set out end-to-end to collectively form a snake shape over the length of the planned trenching activity. In some embodiments, certain sections of the snake-like array can be lined up perpendicular to a trench-line to accommodate digging a structure such as a bell hole. In some embodiments, the array of devices can be comprised of non-identically shaped devices.

In embodiments, devices can be set up to operate individually. In some embodiments, a plurality of devices can be arrayed in a pattern conformable in shape to the warming task at hand. In some embodiments, devices can be aligned to cooperate in ground thawing of a predefined pattern. In some embodiments, the array can comprise a 1×1 array. In other embodiments, the array can comprise a 1×n linear array. In further embodiments, the individual devices can be arrayed in any m×n pattern. In some embodiments, devices can be arrayed to cover and thaw an area in need of repair. In other embodiments, devices can be arrayed in a pattern consistent with the application of a construction material such as sealant, concrete or asphalt. In further embodiments, devices can be arrayed in a pattern that can permit drainage. In yet other embodiments, the array can be configured to permit boring under a structure. In some embodiments, devices can be arrayed linearly over a trench-line or fence-line scheduled for excavation. In some embodiments, devices can be arrayed in a plurality of rows to permit the digging of a basement.

In some embodiments, the pattern can be established in reference to surface and aboveground structures. In some embodiments, the structures can be permanent structures such as buildings. In some embodiments, the aboveground structures can be mechanical or mobile. In some embodiments, the structures can be one or more of the group consisting of rubber-tired construction vehicles, tracked vehicles, trailers, sleds, and vehicles comprising a boom. In some embodiments, members of the array can be held by a crane or rough-terrain forklift.

In some embodiments, the device can comprise a fixed-form device. In some embodiments, the device can comprise an adjustable frame. In some embodiments, the device can comprise a rigid frame suitable for storage and transportation. In some embodiments, the frames for the devices can be configured to permit safe and efficient stacking of the devices in both storage and transportation.

In some embodiments, a device can be used to heat frozen ground. In some embodiments, a device can be used to heat snow- or frost-covered ground. In some embodiments, one or more devices can be used to thaw frozen ground. In some embodiments, one or more devices can be used to thaw ground frozen more than 10 cm from the surface. In some embodiments, one or more devices can be used to thaw ground frozen more than 20 cm from the surface.

In some embodiments, a device can reliably thaw targeted ground in conformance with a production schedule. In some embodiments, the device can have the ground ready when the crew and equipment are ready to engage in the target task. In some embodiments, the device can thaw the targeted ground in 72 hours. In other embodiments, within 48 hours. In further embodiments, within 24 hours. In yet other embodiments, within 12 hour. In yet further embodiments, within 8 hours.

In some embodiments, a device for deep thawing of the ground can employ electromagnetic energy radiated from an energy source. In some embodiments, the device can employ infrared radiation. In some embodiments, the electromagnetic radiation emitted can be optimized in the range of about 0.7 μm to about 1 mm. In some embodiments, all or part of the infrared radiation can be directed at the ground to be thawed by a reflective means. In some embodiments, the device can additionally cause thawing by combining a means for emitting radiation with a means for heating by conduction and/or convection. In some embodiments, the ground can be covered with a substrate to reduce the reflective index of the ground and assist the absorption of energy emitted by the device.

In some embodiments, the thawing device can be portable. In some embodiments, a device can be positioned manually without machine assistance. In some embodiments, the device can be equipped with wheels or a site for attaching a wheeled manual transportation carriage. In some embodiments, the device can be positioned with the assistance of machinery such as a crane or forklift. In some embodiments, two adults without machine assistance can position a device. In some embodiments, a device can comprise a weight in the range of 100 lbs to 500 lbs.

In some embodiments, a device and or a system of devices can be configured to be used safely over dirt, gravel, asphalt, concrete, or other non-flammable construction materials. In some embodiments, the system or device can be configured to be used safely in close proximity to man-made structures. In some embodiments, a device can be configured to be used over ground polluted by hydrocarbons. In some embodiments, a device can be configured to be used in proximity to trees or shrubs.

In some embodiments, a device and or a system of devices can be configured to generate less pollution as compared with conventional heating methods. In some embodiments, the device will not exhaust cinders, ash, smoke, odor, noise or toxic fumes. In some embodiments, the device can exhaust minimal heat energy into the atmosphere. In some embodiments, the device can have sufficiently low emissions so that it may be used indoors.

In some embodiments, the apparatuses described herein can further comprise sensors configured to monitor operating parameters of the apparatus. These parameters can include, but are not limited to, whether the heater is functioning or not, fuel remaining, temperature of the heated air or gas, temperature of the heat exchanger, exhaust gas temperature, and any other parameter of the apparatus that can be monitored as known to those skilled in the art. In some embodiments, the apparatuses can further comprise GPS sensors or transceivers that can be used to monitor and track the location of the apparatuses as part of an inventory control management system.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed is:

1. A ground-heating apparatus, comprising:

a frame configured to sit or be placed on the ground;

a heat exchanger disposed in the frame, the heat exchanger configured to emit heat energy, the heat exchanger further comprising:

a first tube comprising first and second ends, the first end configured to releasably couple to the heater assembly, the second end operatively coupled to a first elbow, a second tube comprising third and fourth ends, the third end operatively coupled to the first elbow thereby defining communication from the first tube to the second tube, the fourth end terminating near the first end, the fourth end configured to be closed, and a third tube having fifth and sixth ends, the third tube disposed within the second tube thereby defining communication from the second tube to the third tube, the fifth end disposed near the fourth end, the sixth end configured to exit from the heat exchanger; and a heater assembly, the heater assembly operatively coupled to the heat exchanger, the heater assembly configured to convey heated air or gas through the heat exchanger.

2. The apparatus as set forth in claim 1, wherein the frame comprises a lattice frame.

3. The apparatus as set forth in claim 1, wherein the frame further comprises a bottom surface having a polygonal shape, a circular shape, an elliptical shape or a combination thereof.

4. The apparatus as set forth in claim 1, wherein the sixth end further comprises a second elbow disposed in the first elbow, the second elbow configured to provide communication from the third tube to outside the heat exchanger.

5. The apparatus as set forth in claim 1, wherein the heat exchanger is configured to emit infrared heat energy.

6. The apparatus as set forth in claim 1, wherein the heater assembly is disposed in a heater module configured to releasably attach to the frame.

7. The apparatus as set forth in claim 6, wherein the heater assembly further comprises:

an enclosure configured to releasably couple with the heat exchanger;

heating means disposed in the enclosure for producing the heated air or gas;

heater control means for controlling the heating means; and a fan or blower configured to convey the heated air or gas from the enclosure into the heat exchanger.

8. The apparatus as set forth in claim 1, further comprising a reflector disposed in the frame, the reflector configured to reflect heat energy emitted from the heat exchanger away from the reflector.

9. The apparatus as set forth in claim 8, wherein the reflector comprises a non-corroding reflecting surface.

10. A system for heating ground, comprising at least one heating apparatus, each at least one heating apparatus comprising:

a frame configured to sit or be placed on the ground;

a heat exchanger disposed in the frame, the heat exchanger configured to emit heat energy, the heat exchanger further comprising:

a first tube comprising first and second ends, the first end configured to releasably couple to the heater assembly, the second end operatively coupled to a first elbow, a second tube comprising third and fourth ends, the third end operatively coupled to the first elbow thereby defining communication from the first tube to the second tube, the fourth end terminating near the first end, the fourth end configured to be closed, and a third tube having fifth and sixth ends, the third tube disposed within the second tube thereby defining communication from the second tube to the third tube, the fifth end disposed near the fourth end, the sixth end configured to exit from the heat exchanger; and a heater assembly, the heater assembly operatively coupled to the heat exchanger, the heater assembly configured to convey heated air or gas through the heat exchanger.

11. The system as set forth in claim 10, wherein the frame comprises a lattice frame.

12. The system as set forth in claim 10, wherein the frame further comprises a bottom surface having a polygonal shape, a circular shape, an elliptical shape or a combination thereof.

13. The system as set forth in claim 10, wherein the sixth end further comprises a second elbow disposed in the first elbow, the second elbow configured to provide communication from the third tube to outside the heat exchanger.

14. The system as set forth in claim 10, wherein the heat exchanger is configured to emit infrared heat energy.

15. The system as set forth in claim 10, wherein the heater assembly is disposed in a heater module configured to releasably attach to the frame.

16. The system as set forth in claim 15, wherein the heater assembly further comprises:

an enclosure configured to releasably couple with the heat exchanger;

heating means disposed in the enclosure for producing the heated air or gas;

heater control means for controlling the heating means; and a fan or blower configured to convey the heated air or gas from the enclosure into the heat exchanger.

17. The system as set forth in claim 10, further comprising a reflector disposed in the frame, the reflector configured to reflect heat energy emitted from the heat exchanger away from the reflector.

18. The system as set forth in claim 17, wherein the reflector comprises a non-corroding reflecting surface.

19. The system as set forth in claim 10, further comprising control means for controlling the at least one heating apparatus.

* * * * *